US010156145B2

(12) United States Patent
Chouhan et al.

(10) Patent No.: US 10,156,145 B2
(45) Date of Patent: Dec. 18, 2018

(54) TURBINE BUCKET HAVING COOLING PASSAGEWAY

(71) Applicant: General Electric Company, Schenectady, NY (US)

(72) Inventors: Rohit Chouhan, Karnataka (IN); Shashwat Swami Jaiswal, Karnataka (IN); Stephen Paul Wassynger, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 313 days.

(21) Appl. No.: 14/923,697

(22) Filed: Oct. 27, 2015

(65) Prior Publication Data

US 2017/0114648 A1 Apr. 27, 2017

(51) Int. Cl.
*F01D 5/18* (2006.01)
*F01D 5/02* (2006.01)
(Continued)

(52) U.S. Cl.
CPC ..... *F01D 5/187* (2013.01); *F01D 5/02* (2013.01); *F01D 5/225* (2013.01); *F01D 9/02* (2013.01);
(Continued)

(58) Field of Classification Search
CPC . F01D 5/187; F01D 5/02; F01D 5/225; F01D 9/02; F01D 11/08; F01D 2220/32;
(Continued)

(56) References Cited

U.S. PATENT DOCUMENTS 3,045,965 A * 7/1962 Bowmer ..... F01D 5/187
416/90 R
3,623,825 A * 11/1971 Schneider ..... F01D 5/18
416/231 R
(Continued)

FOREIGN PATENT DOCUMENTS

EP 0670953 A1 * 9/1995 ..... F01D 5/187
EP 1116861 A2 * 7/2001 ..... F01D 5/187
(Continued)

OTHER PUBLICATIONS

Extended European Search Report and Written Opinion issued in connection with corresponding EP Application No. 16194322.0 dated Mar. 3, 2017.
(Continued)

*Primary Examiner* — Logan Kraft
*Assistant Examiner* — Brian Delrue
(74) *Attorney, Agent, or Firm* — Ernest G. Cusick; Hoffman Warnick LLC

(57) ABSTRACT

A turbine bucket according to various embodiments includes: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; a plurality of radially extending cooling passageways within the body; and at least one bleed aperture fluidly coupled with at least one of the plurality of radially extending cooling passageways, the at least one bleed aperture extending through the body at the trailing edge; and a shroud coupled to the blade radially outboard of the blade.

6 Claims, 10 Drawing Sheets

(51) Int. Cl.
*F01D 9/02* (2006.01)
*F01D 5/22* (2006.01)

(52) U.S. Cl.
CPC .... *F05D 2220/32* (2013.01); *F05D 2240/304* (2013.01); *F05D 2260/20* (2013.01)

(58) Field of Classification Search
CPC ..... F01D 2240/304; F01D 2240/81; F01D 2260/20; F01D 5/18; F01D 5/141
USPC ..... 416/97 R
See application file for complete search history.

(56) References Cited

U.S. PATENT DOCUMENTS 3,658,439 A * 4/1972 Kydd ..... F01D 5/085 416/193 R
3,736,071 A * 5/1973 Kydd ..... F01D 5/08 415/115
3,804,551 A * 4/1974 Moore ..... F01D 5/08 416/193 A
3,844,679 A * 10/1974 Grondahl ..... F01D 5/185 416/95
4,236,870 A * 12/1980 Hucul, Jr. ..... F01D 5/187 415/115
4,350,473 A * 9/1982 Dakin ..... F01D 5/185 415/116
4,474,532 A * 10/1984 Pazder ..... F01D 5/187 415/115
4,940,388 A 7/1990 Lilleker et al.
5,403,159 A * 4/1995 Green ..... F01D 5/187 416/97 R
5,460,486 A 10/1995 Evans et al.
5,464,479 A * 11/1995 Kenton ..... B08B 3/04 134/1
5,488,825 A * 2/1996 Davis ..... F01D 5/187 415/115
5,603,606 A * 2/1997 Glezer ..... F01D 5/187 415/115
5,829,245 A * 11/1998 McQuiggan ..... F01D 5/187 415/114
5,857,837 A * 1/1999 Zelesky ..... F01D 5/187 415/115
5,902,093 A * 5/1999 Liotta ..... F01D 5/187 415/115
6,164,914 A * 12/2000 Correia ..... F01D 5/186 415/115
6,431,832 B1 * 8/2002 Glezer ..... F01D 5/187 416/97 R
6,499,950 B2 12/2002 Willett et al.
6,761,534 B1 * 7/2004 Willett ..... F01D 5/18 416/191
6,824,359 B2 * 11/2004 Chlus ..... F01D 5/187 416/92
6,902,372 B2 * 6/2005 Liang ..... F01D 5/14 415/115
6,974,308 B2 * 12/2005 Halfmann ..... B22C 9/04 415/115
7,066,716 B2 6/2006 Jacala et al.
7,104,757 B2 * 9/2006 Gross ..... F01D 5/187 415/115
7,137,779 B2 * 11/2006 Liang ..... F01D 5/187 416/1
7,198,468 B2 * 4/2007 Papple ..... F01D 5/187 416/97 R
7,303,376 B2 * 12/2007 Liang ..... F01D 5/187 416/233
7,481,623 B1 * 1/2009 Liang ..... F01D 5/186 416/97 R
7,537,431 B1 * 5/2009 Liang ..... F01D 5/187 415/115
7,563,072 B1 * 7/2009 Liang ..... F01D 5/187 415/115
7,645,122 B1 * 1/2010 Liang ..... F01D 5/187 416/97 R
7,686,581 B2 3/2010 Brittingham et al.
7,753,650 B1 * 7/2010 Liang ..... F01D 5/187 416/97 R
7,766,617 B1 * 8/2010 Liang ..... F01D 5/186 415/115
7,780,414 B1 * 8/2010 Liang ..... B22C 9/10 164/369
7,857,589 B1 * 12/2010 Liang ..... F01D 5/187 416/97 R
7,862,299 B1 * 1/2011 Liang ..... F01D 5/147 416/97 R
7,901,181 B1 * 3/2011 Liang ..... F01D 5/186 416/97 R
7,901,183 B1 * 3/2011 Liang ..... F01D 5/186 416/97 R
8,011,888 B1 * 9/2011 Liang ..... F01D 5/186 416/92
8,047,788 B1 * 11/2011 Liang ..... F01D 5/187 416/97 R
8,052,378 B2 * 11/2011 Draper ..... F01D 5/186 415/115
8,052,395 B2 * 11/2011 Tragesser ..... F01D 5/18 416/242
8,070,436 B2 * 12/2011 Mitchell ..... F01D 5/186 415/115
8,100,654 B1 * 1/2012 Liang ..... F01D 5/187 416/97 R
8,113,780 B2 * 2/2012 Cherolis ..... B22C 7/02 416/97 R
8,118,553 B2 * 2/2012 Liang ..... F01D 5/187 415/115
8,177,507 B2 * 5/2012 Pietraszkiewicz ..... F01D 5/186 415/115
8,192,146 B2 * 6/2012 Liang ..... F01D 5/186 415/115
8,297,927 B1 * 10/2012 Liang ..... F01D 5/186 416/97 R
8,348,612 B2 1/2013 Brittingham
8,360,726 B1 * 1/2013 Liang ..... F01D 5/187 416/241 R
8,444,372 B2 * 5/2013 Suthar ..... F01D 11/10 415/1
8,500,401 B1 * 8/2013 Liang ..... F01D 5/186 415/1
8,628,298 B1 * 1/2014 Liang ..... F01D 5/187 416/96 R
8,702,375 B1 * 4/2014 Liang ..... F01D 9/065 415/115
8,801,377 B1 * 8/2014 Liang ..... F01D 5/186 416/97 R
8,920,123 B2 * 12/2014 Lee ..... F01D 5/186 416/92
9,206,695 B2 * 12/2015 Pointon ..... F01D 5/186
9,228,439 B2 * 1/2016 Pointon ..... F01D 5/186
9,314,838 B2 * 4/2016 Pointon ..... B22C 7/02
9,518,469 B2 * 12/2016 Tibbott ..... F01D 5/187
9,885,243 B2 * 2/2018 Chouhan ..... F01D 5/18
2001/0012484 A1 * 8/2001 Beeck ..... B22D 11/0405 416/97 R
2002/0150474 A1 10/2002 Balkcum, III et al.
2002/0197159 A1 * 12/2002 Roeloffs ..... F04D 29/545 416/5
2002/0197160 A1 * 12/2002 Liang ..... F01D 5/186 416/92
2003/0059304 A1 * 3/2003 Leeke ..... F01D 5/186 416/97 R
2003/0118445 A1 * 6/2003 Lee ..... F01D 5/18 416/97 R
2003/0133795 A1 * 7/2003 Manning ..... F01D 5/187 416/97 R
2003/0147750 A1 * 8/2003 Slinger ..... F01D 5/186 416/97 R
2004/0126236 A1 * 7/2004 Lee ..... F01D 5/187 416/97 R

(56) References Cited

U.S. PATENT DOCUMENTS

| | | | | |
|---|---|---|---|---|
| 2004/0146401 | A1* | 7/2004 | Chlus | F01D 5/147 416/97 R |
| 2004/0151582 | A1* | 8/2004 | Faulkner | F01D 5/225 415/173.1 |
| 2005/0111979 | A1* | 5/2005 | Liang | F01D 5/186 416/97 R |
| 2005/0265837 | A1* | 12/2005 | Liang | F01D 5/186 416/97 R |
| 2006/0056969 | A1* | 3/2006 | Jacala | F01D 5/186 416/97 R |
| 2006/0222494 | A1* | 10/2006 | Liang | F01D 5/187 416/97 R |
| 2007/0177976 | A1* | 8/2007 | Cunha | B22C 9/04 416/97 R |
| 2007/0189896 | A1* | 8/2007 | Itzel | F01D 5/187 416/97 R |
| 2008/0008599 | A1* | 1/2008 | Cunha | F01D 5/186 416/97 R |
| 2008/0031738 | A1* | 2/2008 | Lee | F01D 5/18 416/97 R |
| 2008/0056908 | A1* | 3/2008 | Morris | F01D 5/187 416/97 R |
| 2008/0170946 | A1* | 7/2008 | Brittingham | F01D 5/187 416/97 R |
| 2008/0286115 | A1* | 11/2008 | Liang | F01D 5/186 416/97 R |
| 2009/0196737 | A1* | 8/2009 | Mitchell | F01D 5/186 415/115 |
| 2009/0214328 | A1* | 8/2009 | Tibbott | F01D 5/187 415/115 |
| 2009/0304520 | A1* | 12/2009 | Brittingham | F01D 5/187 416/97 R |
| 2010/0040480 | A1* | 2/2010 | Webster | F01D 5/186 416/97 R |
| 2011/0123351 | A1* | 5/2011 | Hada | F01D 5/189 416/97 R |
| 2012/0082567 | A1* | 4/2012 | Tibbott | F01D 5/186 416/97 R |
| 2012/0107134 | A1* | 5/2012 | Harris, Jr. | F01D 5/081 416/97 R |
| 2012/0171047 | A1* | 7/2012 | Itzel | F01D 5/18 416/97 R |
| 2013/0115059 | A1* | 5/2013 | Walunj | F01D 5/081 415/176 |
| 2013/0323080 | A1* | 12/2013 | Martin | F01D 5/186 416/97 R |
| 2014/0093389 | A1* | 4/2014 | Morris | F01D 5/183 416/97 R |
| 2014/0093390 | A1* | 4/2014 | Pointon | F01D 5/186 416/97 R |
| 2014/0093392 | A1* | 4/2014 | Tibbott | F01D 5/189 416/97 R |
| 2016/0017718 | A1* | 1/2016 | Zhang | F01D 5/187 29/889.21 |
| 2017/0114648 | A1 | 4/2017 | Chouhan et al. | |

FOREIGN PATENT DOCUMENTS

| | | | | | |
|---|---|---|---|---|---|
| EP | 1 788 195 | A2 | | 5/2007 | |
| GB | 2005775 | A | | 9/1978 | |
| JP | 59231102 | A | * | 12/1984 | F01D 5/187 |
| JP | 01134003 | A | * | 5/1989 | F01D 5/187 |
| JP | 05156901 | A | * | 6/1993 | |
| JP | 05248204 | A | * | 9/1993 | F01D 5/187 |
| JP | EP 0864728 | A2 | * | 9/1998 | F01D 5/08 |
| JP | 11072005 | A | * | 3/1999 | F01D 5/187 |
| JP | 11223101 | A | * | 8/1999 | F01D 5/225 |
| JP | 2001073704 | A | * | 3/2001 | F01D 5/186 |
| JP | 2001193404 | A | * | 7/2001 | F01D 5/187 |
| JP | 2005054799 | A | * | 3/2005 | F01D 5/20 |
| JP | 2005069236 | A | * | 3/2005 | |
| JP | 2005337256 | A | * | 12/2005 | F01D 5/187 |
| JP | 2006037957 | A | * | 2/2006 | F01D 5/081 |
| JP | 2008169845 | A | * | 7/2008 | F01D 5/187 |
| JP | 2012140946 | A | * | 7/2012 | F01D 5/18 |
| JP | 2013117227 | A | * | 6/2013 | F01D 5/187 |
| JP | 2013144994 | A | * | 7/2013 | |
| JP | 2013245674 | A | * | 12/2013 | F01D 5/20 |
| JP | 2016156377 | A | * | 9/2016 | F01D 5/20 |

OTHER PUBLICATIONS

U.S. Appl. No. 14/923,685, Notice of Allowance dated Nov. 17, 2017, 8 pages.

U.S. Appl. No. 14/923,685, Office Action 1 dated Aug. 15, 2017, 24 pages.

U.S. Appl. No. 14/923,693, (Office Action) dated Mar. 22, 2018, 27 pages.

U.S. Appl. No. 14/923,693, (Final Office Action) dated Aug. 30, 2018, 13 pages.

* cited by examiner

TURBINE BUCKET HAVING COOLING PASSAGEWAY

BACKGROUND OF THE INVENTION

The subject matter disclosed herein relates to turbines. Specifically, the subject matter disclosed herein relates to buckets in gas turbines.

Gas turbines include static blade assemblies that direct flow of a working fluid (e.g., gas) into turbine buckets connected to a rotating rotor. These buckets are designed to withstand the high-temperature, high-pressure environment within the turbine. Some conventional shrouded turbine buckets (e.g., gas turbine buckets), have radial cooling holes which allow for passage of cooling fluid (i.e., high-pressure air flow from the compressor stage) to cool those buckets. However, this cooling fluid is conventionally ejected from the body of the bucket at the radial tip, and can end up contributing to mixing losses in that radial space outboard to the blade shroud.

BRIEF DESCRIPTION OF THE INVENTION

Various embodiments of the disclosure include a turbine bucket having: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; a plurality of radially extending cooling passageways within the body; and at least one bleed aperture fluidly coupled with at least one of the plurality of radially extending cooling passageways, the at least one bleed aperture extending through the body at the trailing edge; and a shroud coupled to the blade radially outboard of the blade.

A first aspect of the disclosure includes a turbine bucket having: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; a plurality of radially extending cooling passageways within the body; and at least one bleed aperture fluidly coupled with at least one of the plurality of radially extending cooling passageways, the at least one bleed aperture extending through the body at the trailing edge; and a shroud coupled to the blade radially outboard of the blade.

A second aspect of the disclosure includes: a turbine bucket including: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; a plurality of radially extending cooling passageways within the body; and at least one bleed aperture fluidly coupled with at least one of the plurality of radially extending cooling passageways, the at least one bleed aperture extending through the body to at least one of the pressure side or the suction side; and a shroud coupled to the blade radially outboard of the blade.

A third aspect of the disclosure includes: a turbine having: a stator; and a rotor contained within the stator, the rotor having: a spindle; and a plurality of buckets extending radially from the spindle, at least one of the plurality of buckets including: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; a plurality of radially extending cooling passageways within the body; and at least one bleed aperture fluidly coupled with at least one of the plurality of radially extending cooling passageways, the at least one bleed aperture extending through the body at the trailing edge; and a shroud coupled to the blade radially outboard of the blade.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which.

DETAILED DESCRIPTION OF THE INVENTION

As noted herein, the subject matter disclosed relates to turbines. Specifically, the subject matter disclosed herein relates to cooling fluid flow in gas turbines.

In contrast to conventional approaches, various embodiments of the disclosure include gas turbomachine (or, turbine) buckets having at least one of pressure side or suction side bleed apertures proximate the radial tip, radially inboard of the bucket shroud. These bleed apertures are fluidly connected with radially extending cooling passageways, which allow for the flow of cooling fluid through the bucket from a radially inner position to the radially outer location of the bleed apertures. In various embodiments, the bleed apertures replace the conventional radial cooling holes which extend through the shroud. That is, in various embodiments, the gas turbine bucket does not include radially facing apertures in the shroud proximate the bleed apertures. In some cases, the bucket includes a plenum radially inboard of the shroud that is fluidly connected with the radially extending cooling passageways. The plenum can be fluidly connected with a plurality of radially extending cooling passageways, and a plurality of bleed apertures.

As denoted in these Figures, the "A" axis represents axial orientation (along the axis of the turbine rotor, omitted for clarity). As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference (c) which surrounds axis A but does not intersect the axis A at any location. It is further understood that common numbering between FIGURES can denote substantially identical components in the FIGURES.

Figure 1:
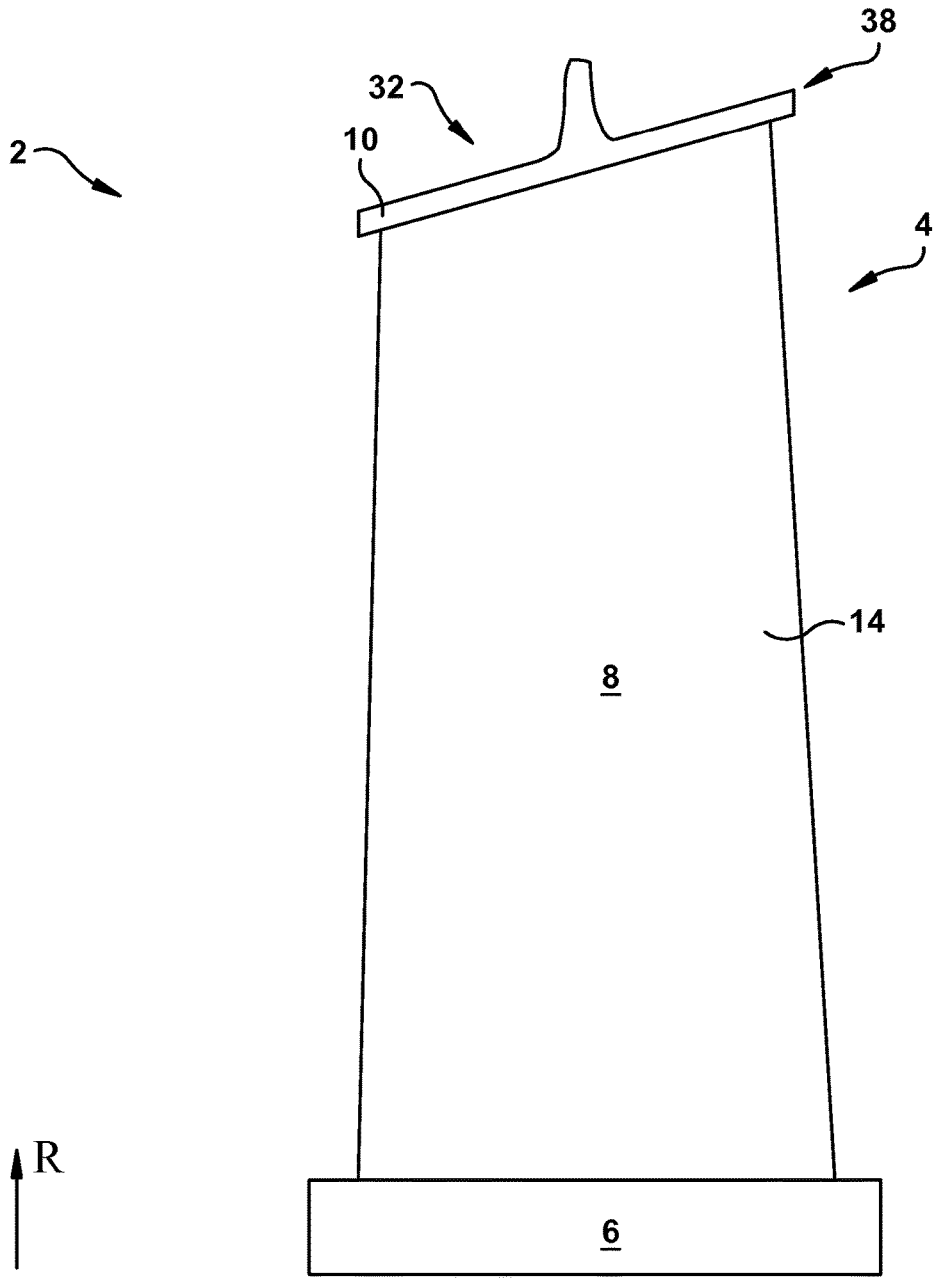
FIG. 1 shows a side schematic view of a turbine bucket according to various embodiments.
Figure 2:
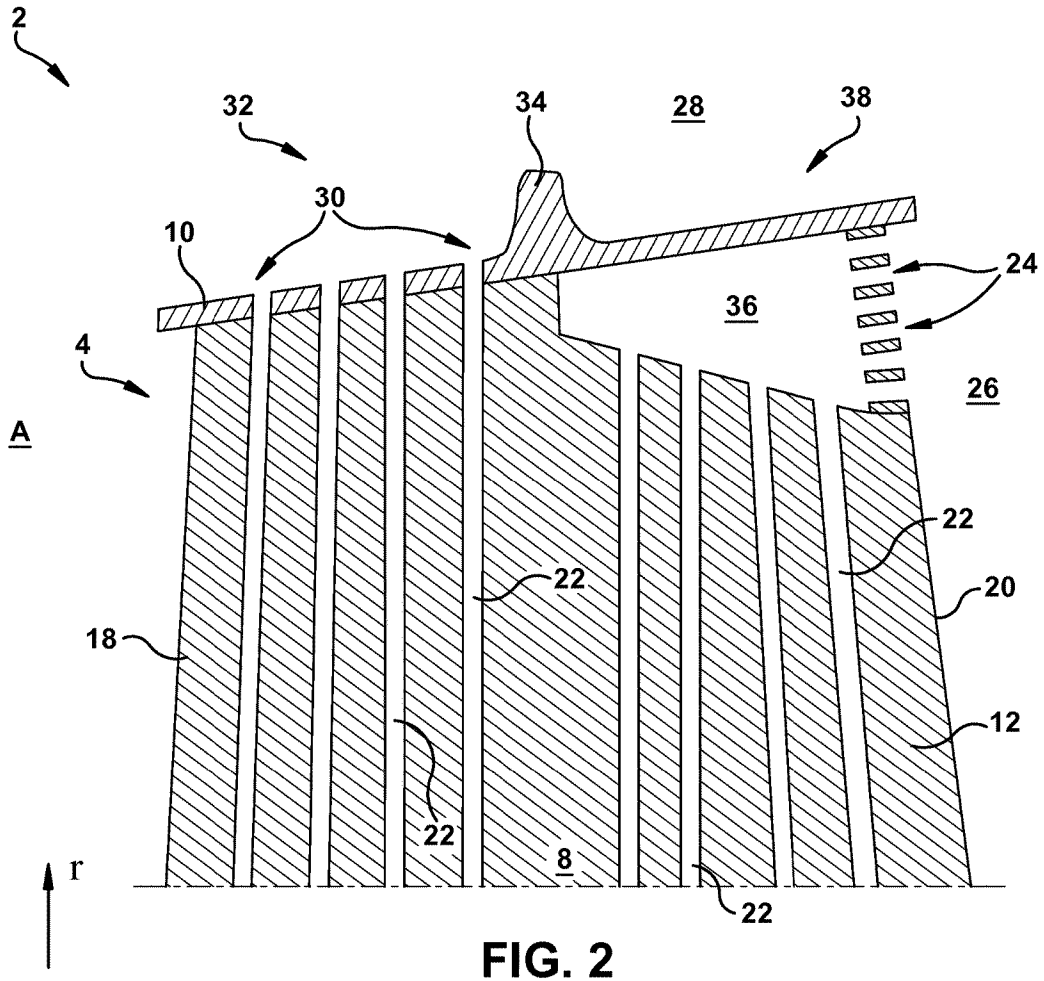
FIG. 2 shows a close-up cross-sectional view of the bucket of FIG. 1 according to various embodiments.

Turning to FIG. 1, a side schematic view of a turbine bucket 2 (e.g., a gas turbine blade) is shown according to various embodiments. FIG. 2 shows a close-up cross-sectional view of bucket 2 (along radially extending cooling passageways), with particular focus on the radial tip section 4 shown generally in FIG. 1. Reference is made to FIGS. 1 and 2 simultaneously. As shown, bucket 2 can include a base 6, a blade 8 coupled to base 6 (and extending radially outward from base 6, and a shroud 10 coupled to the blade 8 radially outboard of blade 8. As is known in the art, base 6, blade 8 and shroud 10 may each be formed of one or more metals (e.g., steel, alloys of steel, etc.) and can be formed (e.g., cast, forged or otherwise machined) according to conventional approaches. Base 6, blade 8 and shroud 10 may be integrally formed (e.g., cast, forged, three-dimensionally printed, etc.), or may be formed as separate components which are subsequently joined (e.g., via welding, brazing, bonding or other coupling mechanism).

Figure 3:
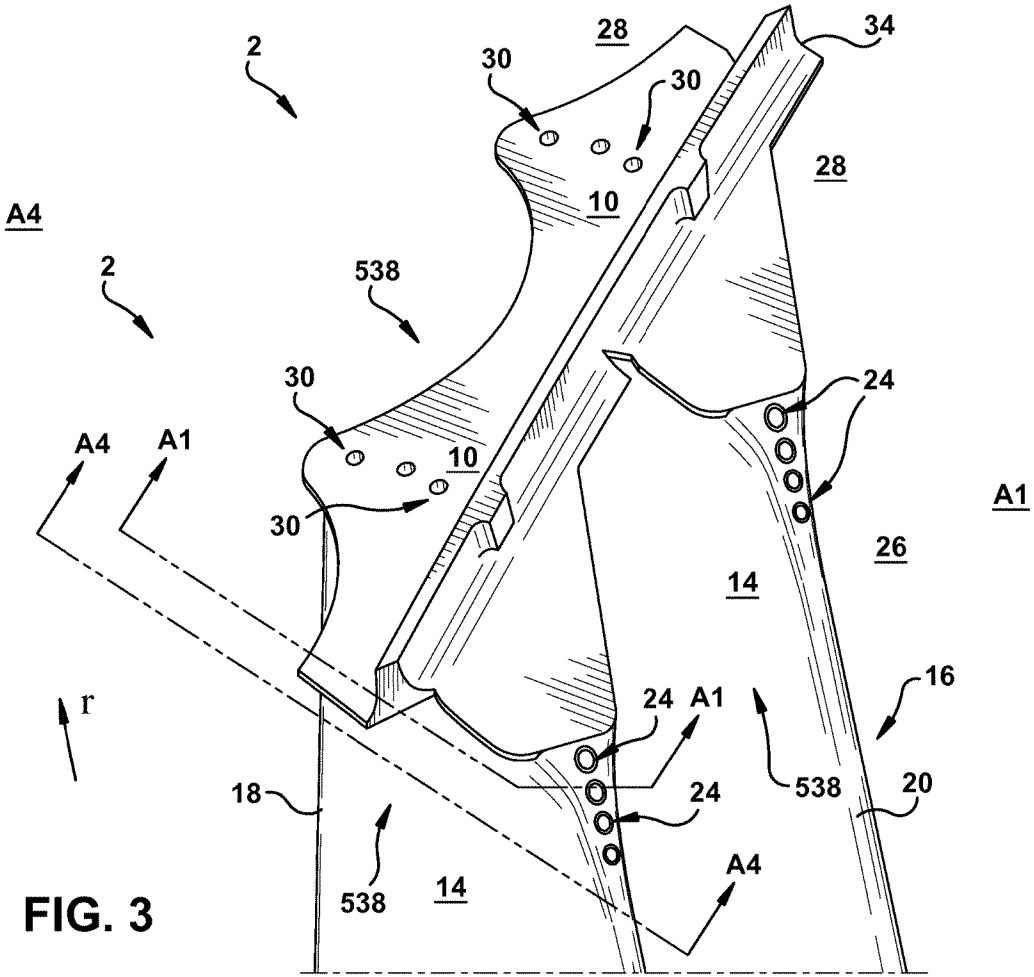
FIG. 3 shows a schematic three-dimensional axial perspective depiction of a pair of buckets according to various embodiments.

FIG. 3 shows a schematic three-dimensional axial perspective depiction of a pair of buckets 2, which form part of a bucket assembly. Reference is made to FIGS. 1-3 simultaneously. In particular, FIG. 2 shows blade 8 which includes a body 12, e.g., an outer casing or shell. The body 12 (FIGS. 1-3) has a pressure side 14 and a suction side 16 opposing pressure side 14 (suction side 16 obstructed in FIG. 2). Body 12 also includes a leading edge 18 between pressure side 14 and suction side 16, as well as a trailing edge 20 between pressure side 14 and suction side 16 on a side opposing leading edge 18. As seen in FIG. 2, bucket 2 also includes a plurality of radially extending cooling passageways 22 within body 12. These radially extending cooling passageways 22 can allow cooling fluid (e.g., air) to flow from a radially inner location (e.g., proximate base 6) to a radially outer location (e.g., proximate shroud 10). The radially extending cooling passageways 22 can be fabricated along with body 12, e.g., as channels or conduits during casting, forging, three-dimensional (3D) printing, or other conventional manufacturing technique. As shown in FIGS. 2 and 3, bucket 2 can further include at least one bleed aperture 24 (several shown) fluidly coupled with at least one of the plurality of radially extending cooling passageways 22. Bleed aperture(s) 24 extend through body 12 at trailing edge 20, and fluidly couple radially extending cooling passageways 22 with exterior region 26 proximate trailing edge 20. That is, in contrast to conventional buckets, bucket 2 includes bleed apertures 24 which extend through body 12 at trailing edge 20, in a location proximate (e.g., adjacent) shroud 10 (but radially inboard of shroud 10). This can allow for adequate cooling of body 12, while reducing mixing losses in the radially outer region 28 (or, radial gap) located radially outboard of shroud 10. In various embodiments, bleed apertures 24 extends along approximately 3 percent to approximately 30 percent of the length of trailing edge 20 toward base 6, as measured from the junction of blade 8 and shroud 10 at trailing edge 20.

According to some embodiments, in order to cool bucket(s) 2, a significant velocity of cooling flow may be required. This velocity can be achieved by supplying higher pressure fluid at bucket base/root 6 relative to the pressure of the fluid/hot gas mixture in the exterior region 26 and/or radially outer region 28. As such, cooling flow exiting to these regions may exit at a relatively high velocity, and be associated with a corresponding relatively high kinetic energy. In conventional designs, ejecting this fluid to the radially outer region not only wastes the energy in that fluid, but can also contribute to mixing losses in the radially outer region (where that flow mixes with fluid flowing around the rail 34. However, diverting some of that higher-velocity fluid flow to exterior region 26, using bucket 2, generates a reaction force on bucket 2, which can increase the overall torque on the bucket 2 (and thus, increase the mechanical shaft power of a turbine employing the bucket(s) 2). Additionally, bucket 2 can aid in reducing two mixing loss mechanism present in conventional buckets: a) bucket 2 significantly reduces mixing losses in the radially outer region associated with mixing of cooling flow and tip leakage; and b) bucket 2 provides cooling flow ejected from the bleed apertures 24 to energize the trailing edge wake (e.g., a low momentum flow past trailing edge) and reduce trailing edge wake mixing losses. As noted herein, the increased torque provided by fluid outlet at bleed apertures 24 and reduced mixing losses, both would help to improve turbine efficiency. Total pressure of cooling flow supplied at base 6 is called supply pressure and static pressure in radially outer region 28 is referred as sink pressure. It is desirable to maintain certain pressure ratio (ratio of total pressure at supply to static pressure at sink) across cooling passages to achieve desirable cooling flow amount and cooling flow velocity in radial passage ways. Static pressure in exterior region 26 is always lower compare to radially outer region 28, therefore total pressure of cooling flow at base (supply pressure) could be reduce while maintain the supply to sink pressure ratio, by taking the advantage of reduced sink pressure in region 26. Bucket 2, 400, 500 will have reduce sink pressure when compared with conventional buckets, thus requiring a lower supply pressure from the compressor to maintain a same pressure ratio. This reduces the work required by the compressor (to compress cooling fluid), and improves efficiency in a gas turbine employing bucket 2, 400,500 relative to conventional buckets.

In some cases, as shown in FIG. 3, shroud 10 includes a plurality of outlet passageways 30 extending from body 12 to radially outer region 28. Outlet passageways 30 are each fluidly coupled with at least one radially extending cooling passageway 22, such that cooling fluid flowing through corresponding radially extending cooling passageway(s) 22 exits body 12 through outlet passageways 30 extending through shroud 10. In various embodiments, as shown in FIG. 2, outlet passageways 30 are fluidly isolated from bleed aperture(s) 24, such that flow (e.g., cooling fluid) from radially extending cooling passageway(s) 22 through bleed aperture(s) 24 does not contact flow (e.g., cooling fluid) from radially extending cooling passageways 22 coupled with outlet passageways 30. In various embodiments, outlet passageways 30 are located proximate leading edge 18 of body 12, such that outlet passageways 30 are located entirely in a leading half 32 (approximate half-way point denoted by notch 34 in shroud 10) of shroud 10. Bleed aperture(s) 24 and the passage connecting the bleed aperture 24 to plenum 36 (described further herein) could be generated using different geometric shapes, e.g., of constant dimension, such that a cross-section of the passage could be a circle, an ellipse, etc. In another aspect, the passage between bleed aperture(s) 24 and plenum 36 may have a tapered cross-section, which tapers from plenum to outlet of bleed aperture(s) 24, or tapers from outlet of bleed aperture(s) 24 to plenum 36.

According to various embodiments described herein, bucket 2 can further include a plenum 36 within body 12, where plenum 36 is fluidly connected with a plurality of radially extending cooling passageways 22 and at least one of bleed aperture(s) 24. Plenum 36 can provide a mixing location for cooling flow from a plurality of radially extending cooling passageways 22, and may outlet to trailing edge 20 through bleed apertures 24. Plenum 36 can fluidly isolate a set of radially extending cooling passageways 22 from other radially extending cooling passageways 22 (e.g., passageways 22 in trailing half 38 from leading half 32). In some cases, as shown in FIG. 2, plenum 36 can have a trapezoidal cross-sectional shape within body 12 (when cross-section is taken through pressure side face), such that it has a longer side at the trailing edge 20 than at an interior, parallel side. According to various embodiments, plenum 36 extends approximately 3 percent to approximately 20 percent of a length of trailing edge 20.

Figure 5:
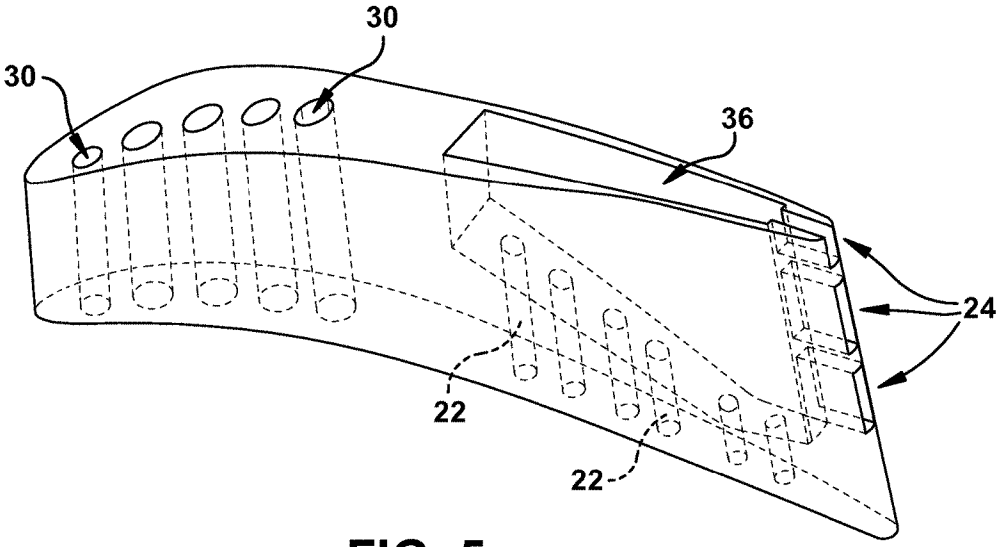
FIG. 5 shows a partially transparent three-dimensional perspective of the bucket of FIGS. 2-4, with shroud removed.
Figure 4:
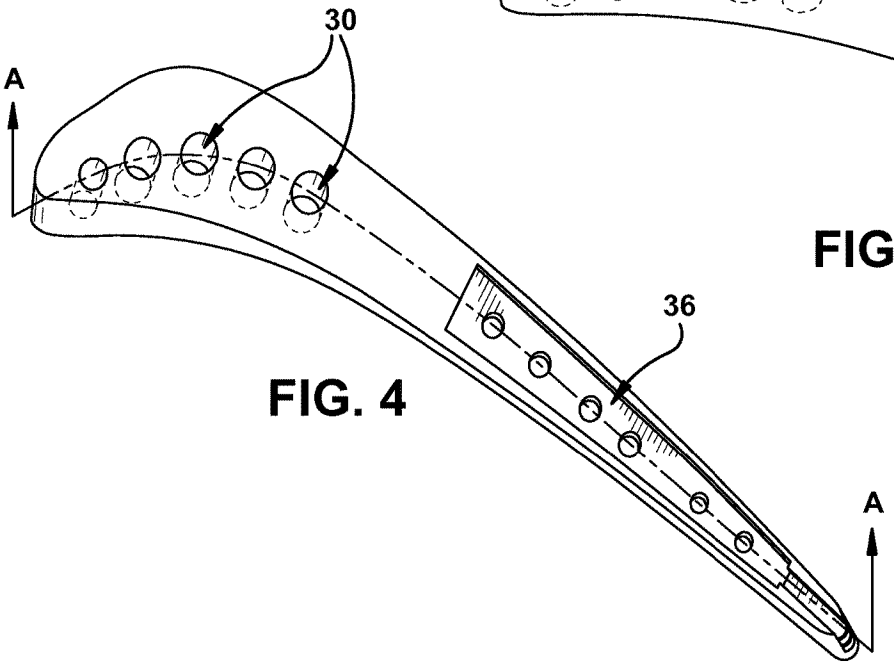
FIG. 4 shows an end view of a portion of the bucket in FIGS. 2 and 3.

FIG. 4 shows an end view of bucket 2, and FIG. 5 shows a partially transparent three-dimensional perspective of bucket 2, with shroud 10 removed (such that plenum 36 is not sealed). It is understood that FIG. 2 shows bucket 2 in cross-section through line A-A.

Figure 6:
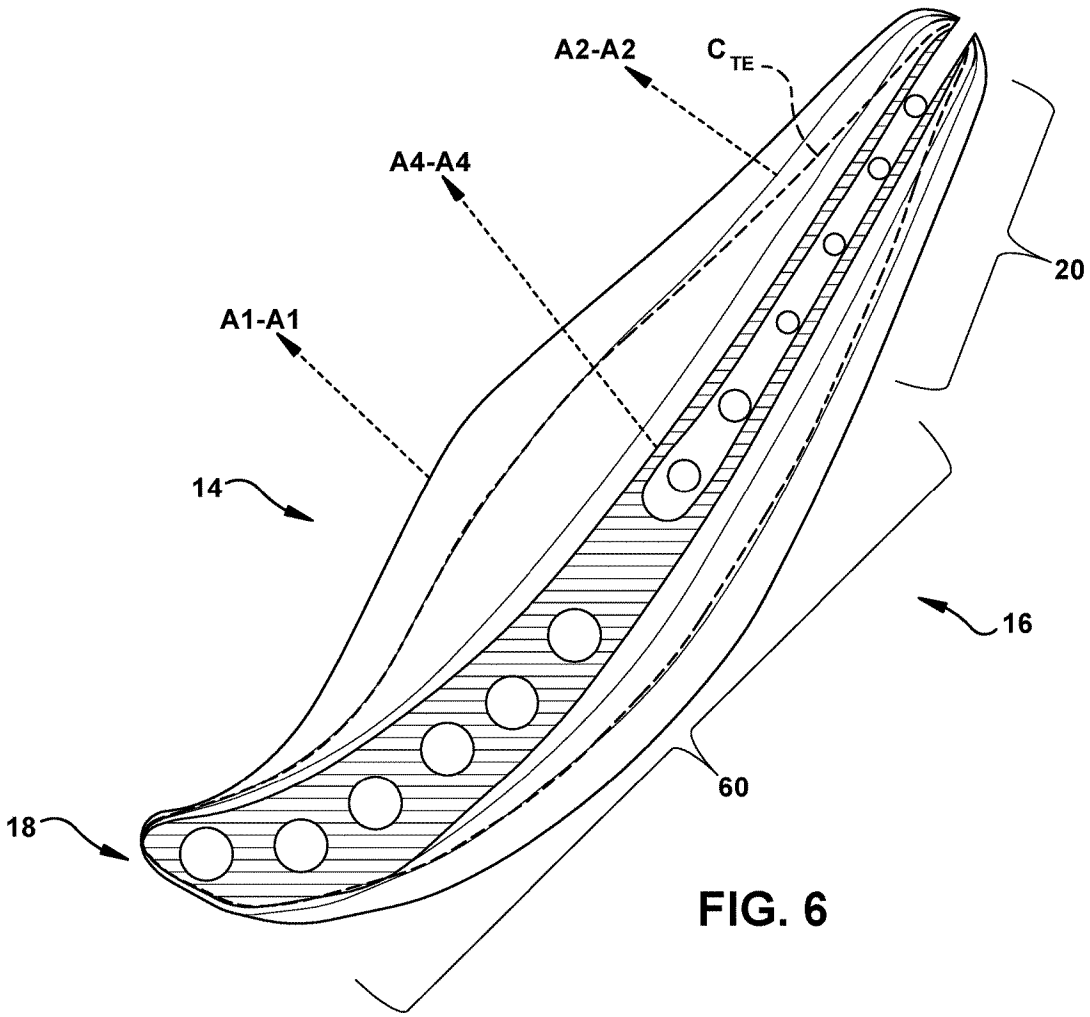
FIG. 6 shows a cut-away view of bucket 2, taken through cross-sections A1-A1 and A4-A4 in FIG. 3.

FIG. 6 shows a cut-away view of bucket 2, taken through cross-sections A1-A1 (A1-A1 is a cross-section within the tip fillet between shroud 10 and blade 8) and A4-A4 (A4-A4 is a cross-section of blade 8 just underneath tip fillet between shroud 10 and blade 8) in FIG. 3. This view demonstrates another aspect of the bucket 2, including its inflated trailing edge section 20. FIG. 6 illustrates inflated trailing edge in part of section 20 relative to conventional trailing edge designs $C_{TE}$, where $C_{TE}$ is a cross section taken on a conventional bucket on the same location as cross-section A2-A2 of bucket 2. Comparison of section A2-A2 with $C_{TE}$ shows that section 20 has greater volume to accommodate bleed apertures 24 when compared with the conventional trailing edge designs, while maintaining sufficient metal wall thickness for structural integrity. The term "$C_{TE}$" refers to the shape of a conventional trailing edge of a turbine blade, which is used as a point of comparison with the various embodiments of the present disclosure. The dotted line in FIG. 6 represents a profile of a conventional blade taken through A2-A2, and the difference between that conventional profile and the various embodiments of the present disclosure is particularly pronounced in the trailing edge area. Distinct cross-sectional profiles, such as A1-A1, A2-A2 and A4-A4 are depicted and described with respect to FIGS. 3 and 6.

Figure 8:
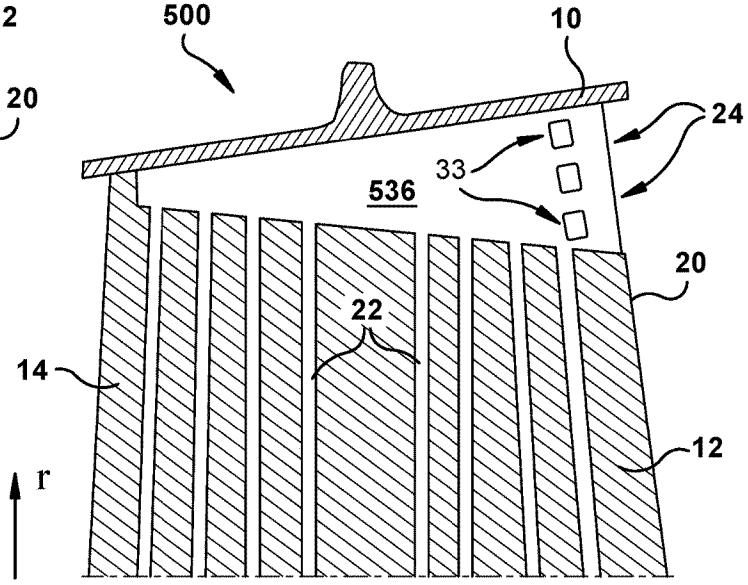
FIG. 8 shows a close-up cross-sectional view of a bucket according to various additional embodiments.
Figure 7:
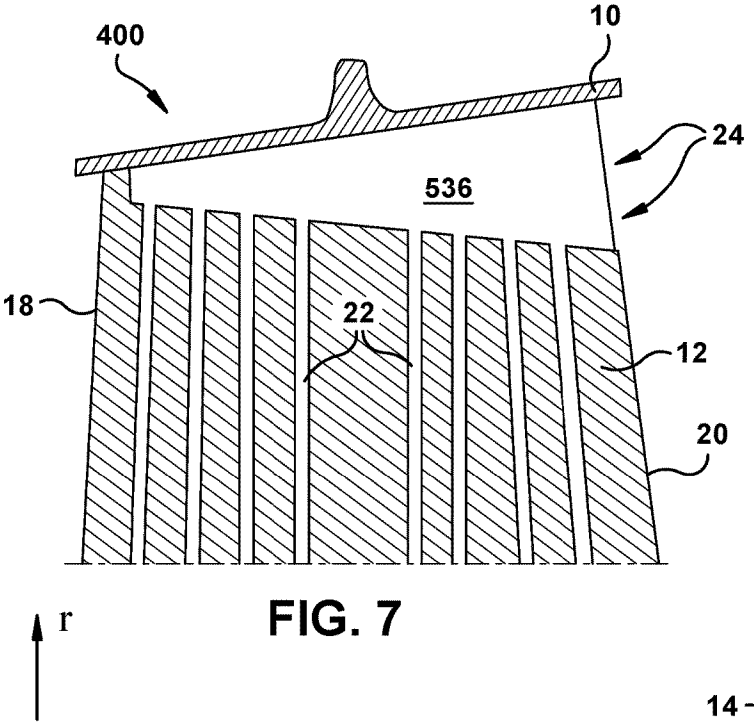
FIG. 7 shows a close-up cross-sectional view of a bucket according to various embodiments.

In various alternative embodiments, as shown in the cross-sectional depictions of buckets 400 and 500 in FIGS. 7 and 8, respectively, an extended plenum 536 can extend within body 12 to fluidly connect with all of radially extending passageways 22. In these embodiments, shroud 10 can be radially sealed to body 12, that is, shroud 10 is without any outlet passageway 30. As such, in bucket 400 (FIG. 7), an entirety of the cooling fluid passing through radially extending cooling passageways 22 exits body 12 through bleed aperture(s) 24. FIG. 8 shows a particular alternative embodiment including both bleed apertures 24 and pressure-side outlet 33. In this embodiment, bucket 500 includes at least one pressure-side outlet 33 on pressure side 14 of body 12. Pressure side outlet(s) 33 can be fluidly coupled with extended plenum 536, and can allow for flow of cooling fluid from extended plenum 536 to the hot gas flow path 538 (shown in FIG. 3) for mixing with working fluid. In various embodiments, extended plenum 536 can span approximately 60 to approximately 90 percent of a width of blade 8 as measured along its junction with shroud 10.

Figure 10:
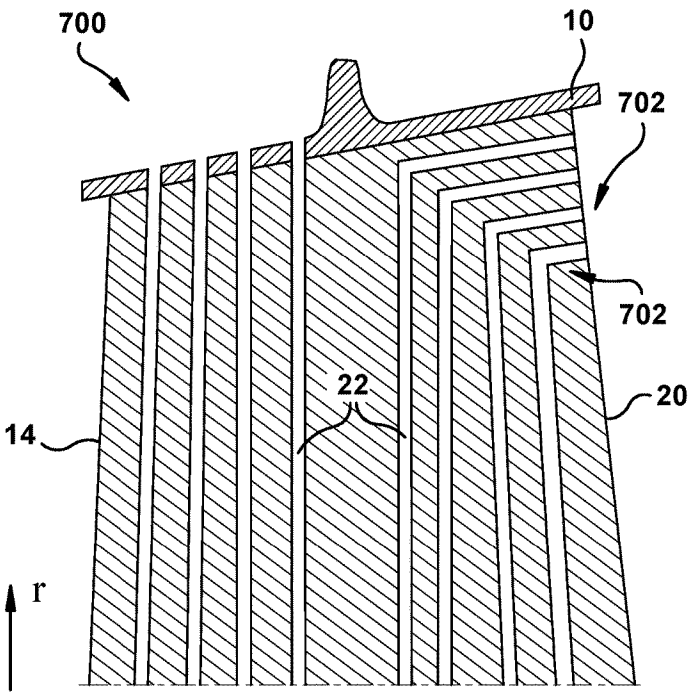
FIG. 10 shows a close-up cross-sectional view of a bucket according to additional embodiments.
Figure 9:
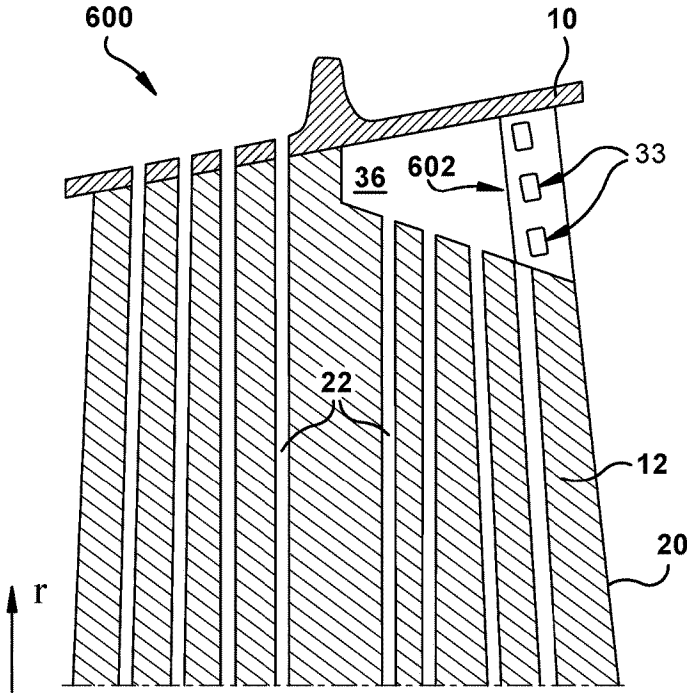
FIG. 9 shows a close-up cross-sectional view of a bucket according to embodiments.

FIGS. 9 and 10 show cross-sectional depictions of buckets 600 and 700, respectively, according to various additional embodiments. FIG. 9 shows bucket 600 having plenum 36 with a partition (e.g., bend) 602 extending at least partially within plenum 36 across the depth of trailing edge 20 (into the page). In this embodiment, bucket 600 includes at least one pressure-side outlet 33 on pressure side 14 of body 12. Pressure side outlet(s) 33 can be fluidly coupled with plenum 36, and can allow for flow of cooling fluid from plenum 36 to the hot gas flow path 538 (shown in FIG. 3) for mixing with working fluid. In various embodiments, partition 602 can extend approximately 3 percent to approximately 20 percent of a depth of blade 8 as measured along trailing edge 20 between pressure side 14 and suction side 16. It is understood that according to various embodiments, plenum 36 can include a plurality of partitions (e.g., similar to partition 602), dividing plenum 36 into multiple parts. Further, it is understood that plenums described herein (e.g., plenum 36) can take on various geometric shapes, and that those shapes shown and described herein are merely illustrative. FIG. 10 shows bucket 700, including a plurality of cross-drilled holes 702, each fluidly connected with a distinct one of radially extending cooling passageways 22. Each cross-drilled hole 702 can outlet at trailing edge 20, and in various embodiments, is aligned at an angle (e.g., approximately a 75-105 degree angle) with its respective radially extending cooling passageway 22.

Figure 11:
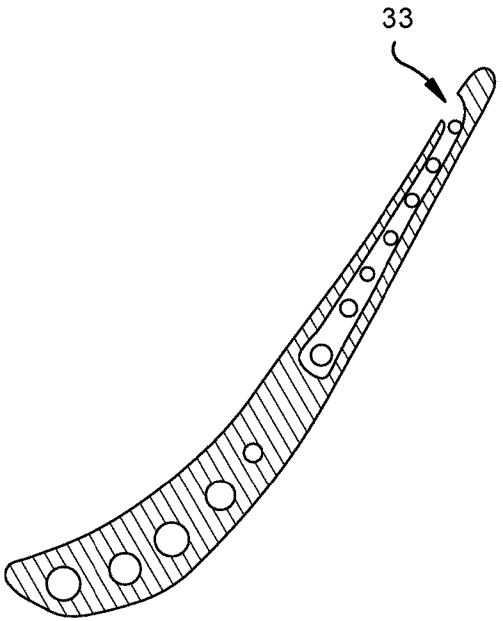
FIG. 11 shows a top cross-sectional depiction of a bucket according to various embodiments.
Figure 12:
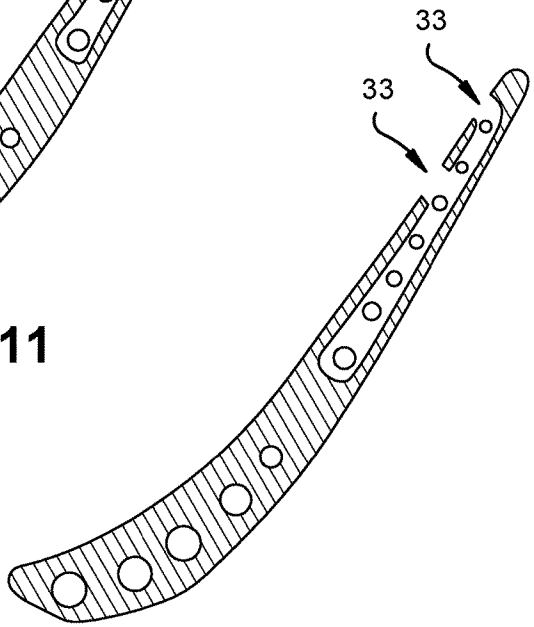
FIG. 12 shows a top cross-sectional depiction of a bucket according to various additional embodiments.
Figure 13:
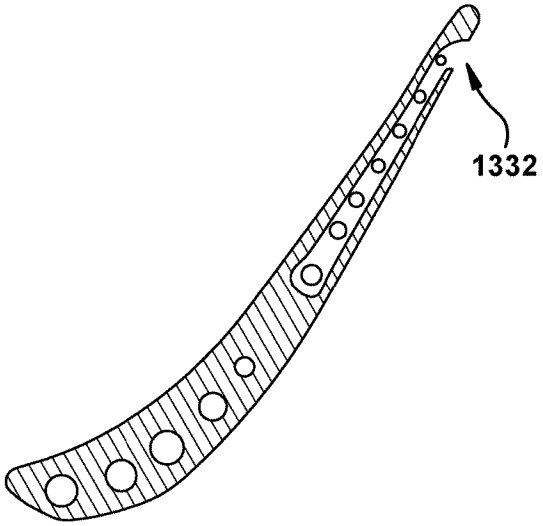
FIG. 13 shows a top cross-sectional depiction of a bucket according to further embodiments.

FIGS. 11, 12 and 13 show top cross-sectional depictions of buckets, including examples of pressure side outlets 33 and suction-side outlets 1332, according to various embodiments.

Figure 14:
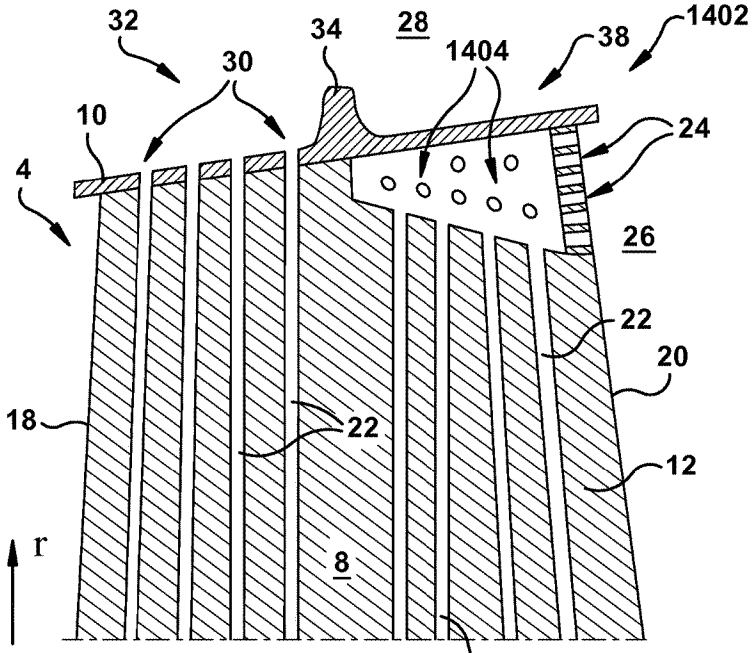
FIG. 14 shows a close-up cross-sectional view of a bucket according to embodiments.
Figure 15:
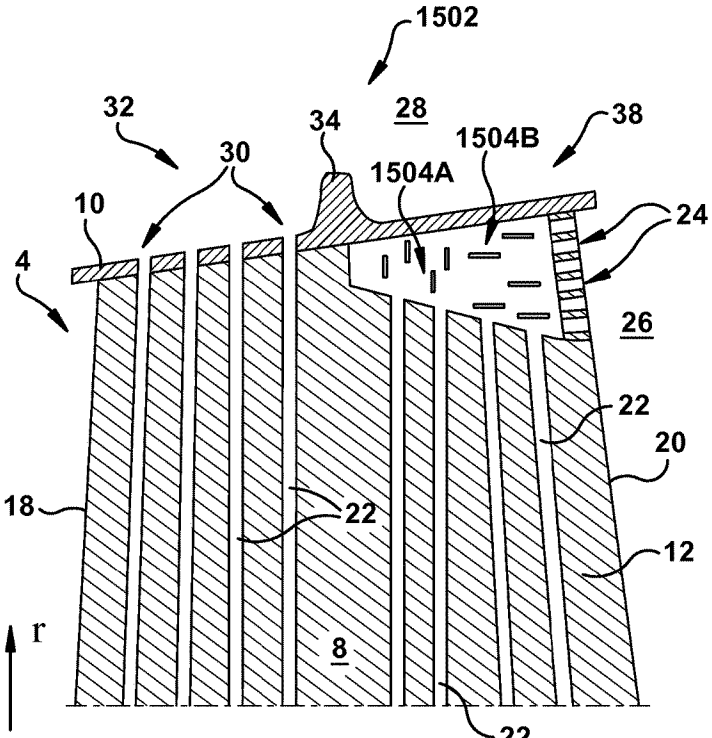
FIG. 15 shows a close-up cross-sectional view of a bucket according to additional embodiments.

FIGS. 14 and 15 show side cross-sectional depictions of additional embodiments of buckets 1402 and 1502, respectively. Bucket 1402 can include an array of pins (e.g., a pin bank array) 1404 within plenum 36 (not labeled) for modifying a direction of the flow of fluid through plenum 36 and to bleed aperture(s) 24. These pins 1404 can improve heat transfer and reduce the blade metal temperature of pressure and/or suction walls of blade 8 in plenum region. Additionally these pins 1404 connect the inner surfaces of the pressure wall and suction wall, and act as structural reinforcement to improve structural integrity. Bucket 1502 can include a plurality of flow turbulators 1504, including at least one of radially oriented turbulators 1504A (extending along r axis) or circumferentially oriented turbulators 1504B (extending along axis perpendicular to r axis). Turbulators 1504A, 1504B can modify distribution and/or direction of the flow of fluid through plenum 36 and to bleed apertures 24. Further, in some embodiments, turbulators 1504B could connect the suction-side wall with the pressure side wall of blade 8 to provide structural support, and/or divide plenum 36 in multiple chambers to regulate the distribution of cooling flow within plenum 36 before exiting through bleed apertures 24.

Figure 16:
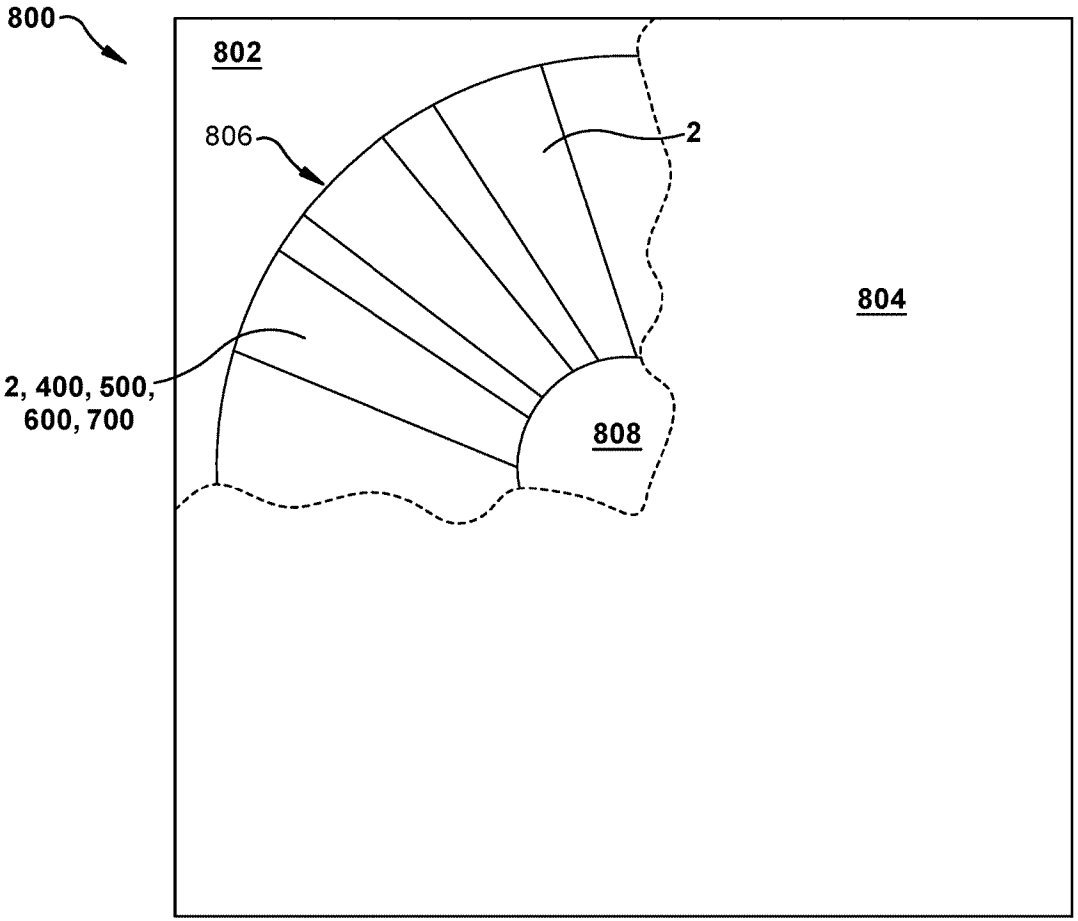
FIG. 16 shows a schematic partial cross-sectional depiction of a turbine according to various embodiments It is noted that the drawings of the invention are not necessarily to scale. The drawings are intended to depict only typical aspects of the invention, and therefore should not be considered as limiting the scope of the invention. In the drawings, like numbering represents like elements between the drawings.

FIG. 16 shows a schematic partial cross-sectional depiction of a turbine 800, e.g., a gas turbine, according to various embodiments. Turbine 800 includes a stator 802 (shown within casing 804) and a rotor 806 within stator 802, as is known in the art. Rotor 806 can include a spindle 808, along with a plurality of buckets (e.g., buckets 2, 400, 500, 600 and/or 700) extending radially from spindle 808. It is understood that buckets (e.g., buckets 2, 400, 500, 600 and/or 700) within each stage of turbine 800 can be substantially a same type of bucket (e.g., bucket 2). In some cases, buckets (e.g., buckets 2, 400, 500, 600 and/or 700) can be located in a mid-stage within turbine 800. That is, where turbine 800 includes four (4) stages (axially dispersed along spindle 808, as is known in the art), buckets (e.g., buckets 3, 400, 500, 600 and/or 700) can be located in a second stage (stage 3) within turbine 800, or, where turbine 800 includes five (5) stages (axially dispersed along spindle 808), buckets (e.g., buckets 2, 400, 500, 600 and/or 700) can be located in a third stage (stage 3) or/and fourth stage (stage 4) within turbine 800.

It is understood that according to various embodiments, any of buckets (e.g., buckets 2, 400, 500, 600 and/or 700) described herein can include a plenum that may be formed as a cast feature (e.g., via casting). In other cases, a plenum may be formed by electrical discharge machining (EDM), e.g., machining from the radial tip of body. In various embodiments, apertures, pathways and other holes may be formed in any of buckets via conventional machining processes. Any of the components described herein may be formed using three-dimensional (3D) printing).

It is understood that while various embodiments herein disclose a plenum that is sealed from the radial outlet of blade, in some particular embodiments, it is possible to form one or more outlet passageways from plenum to radial tip, in addition to trailing edge apertures described herein.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine bucket comprising:

a base;

a blade coupled to the base and extending radially outward from the base, the blade including:

a body having:

a pressure side; a suction side opposing the pressure side; a leading edge between the pressure side and the suction side; and a trailing edge between the pressure side and the suction side on a side opposing the leading edge;

a first set of radially extending cooling passageways within the body;

a second set of radially extending cooling passageways within the body, fluidly isolated from the first set of radially extending cooling passageways within the body, wherein the first set of radially extending cooling passageways is closer to the leading edge of the body than the second set of radially extending cooling passageways measured along an axis of the body perpendicular to a radial direction;

at least one bleed aperture fluidly coupled with at least one of the second set of radially extending cooling passageways, the at least one bleed aperture extending through the body to at least one of the pressure side or the suction side; and a plenum within the body, the plenum directly fluidly connected with the second set of radially extending cooling passageways and the at least one bleed aperture, wherein the plenum fluidly isolates the second set of radially extending cooling passageways from the first set of radially extending cooling passageways within the body, wherein the plenum is located radially outboard of the second set of radially extending cooling passageways within the body, and wherein the plenum outlets directly to the trailing edge of the body through the at least one bleed aperture; and a shroud coupled to the blade radially outboard of the blade, wherein the shroud is radially sealed to the body such that the second set of radially extending cooling passageways are without any outlet passageway at a radial tip of the body, and wherein an entirety of a cooling fluid passing through the second set of radially extending cooling passageways exits the body through the at least one bleed aperture.

2. The turbine bucket of claim 1, wherein the shroud includes a plurality of outlet passageways extending from the body to a radially outer region.

3. The turbine bucket of claim 2, wherein the plurality of outlet passageways are fluidly isolated within the body from the at least one bleed aperture.

4. The turbine bucket of claim 3, wherein the plurality of outlet passageways are fluidly coupled with the first set of radially extending cooling passageways.

5. The turbine bucket of claim 1, further comprising an additional bleed aperture fluidly coupled with at least one of the second set of radially extending cooling passageways, the additional bleed aperture extending through the body at the trialing edge.

6. The turbine bucket of claim 1, wherein outlets of the first set of radially extending cooling passageways are fluidly isolated within the body from the plenum.

* * * * *